US006477495B1

(12) United States Patent
Nukaga et al.

(10) Patent No.: US 6,477,495 B1
(45) Date of Patent: Nov. 5, 2002

(54) SPEECH SYNTHESIS SYSTEM AND PROSODIC CONTROL METHOD IN THE SPEECH SYNTHESIS SYSTEM

(75) Inventors: Nobuo Nukaga, Tokyo (JP); Yoshinori Kitahara, Tachikawa (JP); Keiko Fujita, Tachikawa (JP); Haru Ando, Kodaira (JP); Shunichi Yajima, Hachioji (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/259,333

(22) Filed: Mar. 1, 1999

(30) Foreign Application Priority Data

Mar. 2, 1998 (JP) ..... 10-049161

(51) Int. Cl.[7] ..... G10L 13/08
(52) U.S. Cl. ..... 704/268; 704/260
(58) Field of Search ..... 704/4, 9, 10, 258, 704/260, 268, 261, 267

(56) References Cited

U.S. PATENT DOCUMENTS 4,771,385 A * 9/1988 Egami et al. ..... 704/10
4,931,936 A * 6/1990 Kugimiya et al. ..... 704/4
5,475,796 A * 12/1995 Iwata ..... 704/260
5,633,984 A * 5/1997 Aso et al. ..... 704/260
5,842,167 A * 11/1998 Miyatake et al. ..... 704/260
5,845,047 A * 12/1998 Fukada et al. ..... 704/268
6,035,272 A * 3/2000 Nishimura et al. ..... 704/260

* cited by examiner

*Primary Examiner*—David D. Knepper
(74) *Attorney, Agent, or Firm*—Mattingly, Stanger & Malur, P.C.

(57) ABSTRACT

A prosodic parameter for an input text is computed by storing a sentence of vocalized speech in a speech corpus memory, searching for a stored text having a similar prosody to an input text as a key to the speech corpus and modifying the prosodic parameter based upon the search results. Because a plurality of prosodic parameters are handled as a linking data, a synthesized sound similar to natural speech having a natural intonation and prosody is produced.

20 Claims, 7 Drawing Sheets

SPEECH SYNTHESIS SYSTEM AND PROSODIC CONTROL METHOD IN THE SPEECH SYNTHESIS SYSTEM

BACKGROUND OF THE INVENTION

1. Field of the Invention

The present invention relates to synthesizing speech from text. In particular, the invention relates to prosodic control which controls intonation and duration of a sentence.

2. Description of the Related Art

In general, text to speech synthesis is performed by the following procedure. First, text to be synthesized is inputted and intermediate phonetic symbol sequences are produced. Then, prosodic parameters and vocal tract transfer functions are acquired on the basis of the intermediate phonetic symbol sequences. The prosodic parameter may be a fundamental frequency pattern or the duration of a phoneme. Synthetic speech is subsequently obtained by use of these parameters. For instance, a speech synthesis system is described in Keikichi Hirose, "Speech Synthesis Technology", Speech Processing Technology and its Applications, Information Processing, pages 984–991 (November 1997).

If the procedure described above is used, the prosodic parameters determine naturalness relating to intonation, rhythm and smoothness of the speech and the vocal tract transfer functions determine the intelligibility of individual syllables that make up a word or a sentence.

Among the prosodic parameters, the "added-type model" is a typical model for generating fundamental frequency pattern parameters. The generation model of this fundamental frequency pattern adds a rising or falling accent component to the fundamental frequency, e.g. corresponding to an accent type for a sentence syllable to a phrase component where a fundamental frequency goes down smoothly in response to a phrase. Although the added-type model is easy to be understood intuitively and matches with an actual speech phenomenon because this model imitates a human vocalization structure, there is a problem that sophisticated language processing is required to make this model work.

The duration of a phoneme as a prosodic parameter, depends on the context in which the phoneme is placed, ie. the context of the syllable. There are many factors which affect the duration of the phoneme such as modulation constraints, timing, importance of a word, indication of speech boundaries, tempo within speech areas, and syntactical meaning. Statistical analysis is typically performed against actual measurements of duration time data in order to determine the degree to which each of these factors affects duration, and the rules thus obtained are applied. However, maintaining the large-scale database that is needed to construct duration modules in a variety of contexts is a problem.

Apart from these prosodic parameters, there have been proposals for a variety of control modes for power-related parameters. However, all of these models are prosodic parameter independent models, and there is a natural limit to the extent to which the performance of these independent control models can be improved. It has been pointed out that the modeling of sentence speech according to rules is difficult according to a prosodic phenomenon.

The creation of a database built from prosodic parameters selected from natural speech has been proposed. The database would be used by a prosodic parameter model to calculate prosodic parameters, as proposed, for instance, in Katae et al, "A Domain Specific Text-to-Speech System Using a Prosody Database Retrieved with a Sentence Structure", Studies in Sound, pages 275–276 (March 1996); or in Saito et al, "A Rule-Based Speech Synthesis Method Using Fuzokugo-Sequence Unit", Studies in Sound, pages 317–319 (June 1998). However, these publications introduce only the fundamental frequency pattern as a prosodic parameter and are insufficient for improving the naturalness of sentence speech (speaking in sentences).

SUMMARY OF THE INVENTION

The present invention relates to a speech synthesis system for synthesizing an improved speech having a natural characteristic by editing and processing each prosodic parameter (fundamental frequency pattern, the duration of phoneme, etc.) of natural speech.

The present invention provides a text speech synthesis system for synthesizing a speech having an improved natural characteristic as compared with the conventional method by: providing a speech corpus that includes a speech sentence, prosodic parameters of the speech sentence and morphological element/structured sentence analysis data; abstracting data wherein a similarity degree with an input sentence becomes largest by searching the speech corpus; creating and correcting prosodic parameters for the abstracted data; and thereby producing prosodic parameters to be used in the synthesizing.

BRIEF DESCRIPTION OF THE DRAWINGS

The embodiments of the present invention are described below in conjunction with the figures, in which.

DESCRIPTION OF THE PREFERRED EMBODIMENT

In linguistics, prosody is the science and study of versification and meters. Prosodic parameters determine the naturalness of speech, such as clarity, stress and intonation patterns of an utterance, and smoothness. Prosodic parameters include the following for a unit of speech, for example a phoneme: tone, accent, tone modulation, a fundamental frequency pattern, duration, and vocal transfer function. A phoneme is a small unit or element of a set. In linguistics, each phoneme is a basic unit of speech sound by which morphemes, words and sentences are represented. The phonemes are the differences in sound that indicate a difference in meaning for a language. There are usually 20 to 60 different phonemes in a set for a particular language. An accent gives prominence to a word or phoneme by changing one or more of loudness, duration and pitch. A morpheme is a minimal grammatical unit of a language that constitutes a meaningful word or part of a word, which minimal grammatical unit cannot be divided into smaller independent grammatical parts. Morphemic is the manner of combining morphemes to form words, and morphology is the study of combining morphemes in patterns to form words.

In general, a speech corpus is a large collection of utterances, such as words or sentences or sentence fragments, in the present case, representative of a language being transformed from text to speech.

Structural linguistics is the study of a language wherein elements of a language are defined in terms of their contrasts to other elements by using phonology (how the element sounds), morphology (the pattern or combination of morphemes in a word formulation to include inflection derivation and composition), and syntax (grammatical rules leading to word and punctuation classification). The morphological analysis, as a manifestation of structural linguistics, leads to a morphological analysis result, for example 703, which is the structured parameter sequence of element 702, 704, 705, and 707.

A mora is a unit of time equivalent to the ordinary short sound or syllable, with a plurality being morae.

A description will be given of the present invention by reference to the accompanying drawings.

Figure 1:
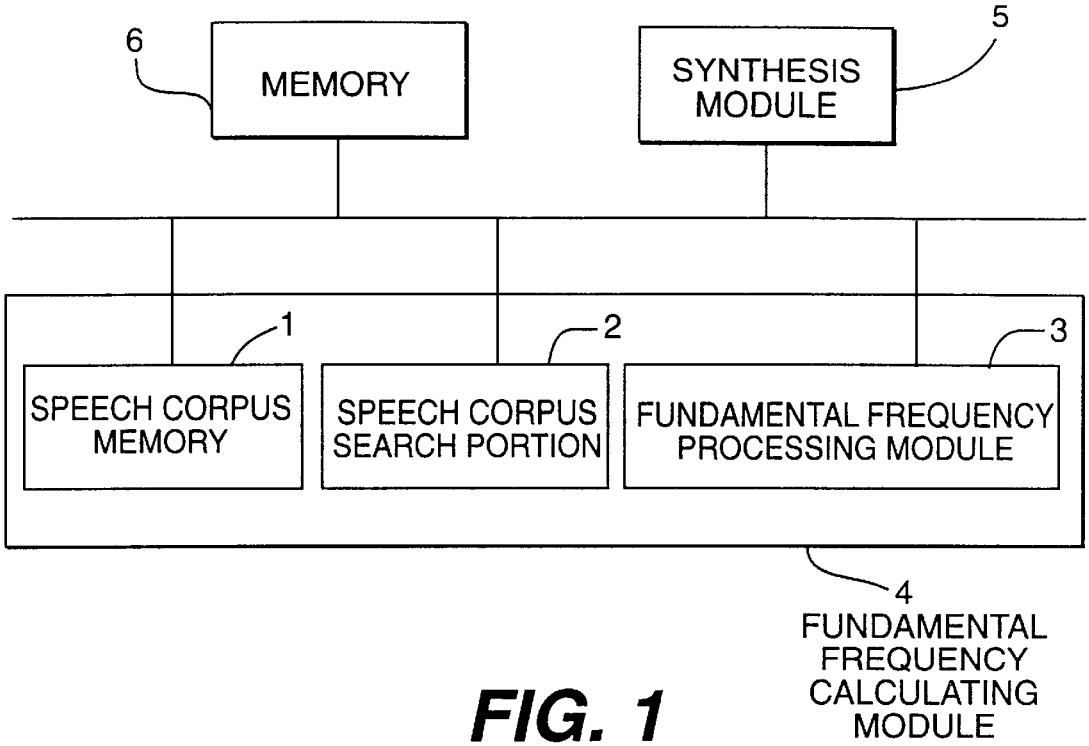
FIG. 1 shows a block diagram of a speech synthesized system based on the present invention.

FIG. 1 shows a block diagram embodying a speech synthesis system of the present invention. This diagram shows a bus interconnecting units that include a memory 6, a fundamental frequency calculating module 4 and a synthesis module 5. The fundamental frequency calculating module 4 includes a speech corpus memory 1, a speech corpus search module 2 and a fundamental frequency processing module 3.

Figure 2:
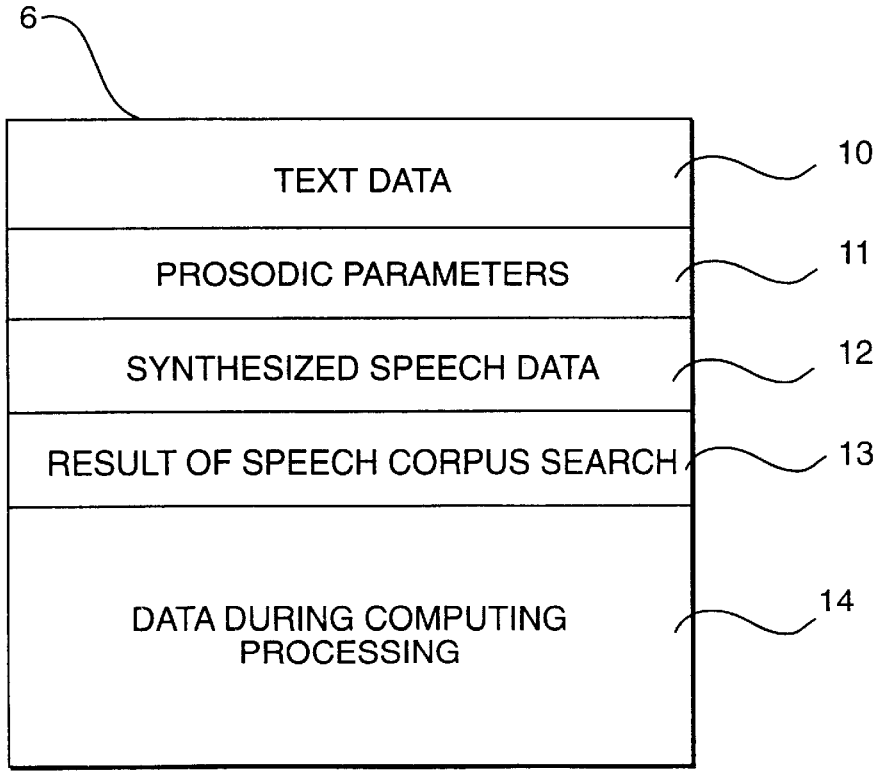
FIG. 2 shows a diagram indicating content stored in a memory of the speech synthesized system as in FIG. 1.

FIG. 2 shows the content of the memory 6 which includes text data 10, prosodic parameters 11, synthesized speech data 12, results of speech corpus search 13, and data stored during computer processing 14.

Figure 3:
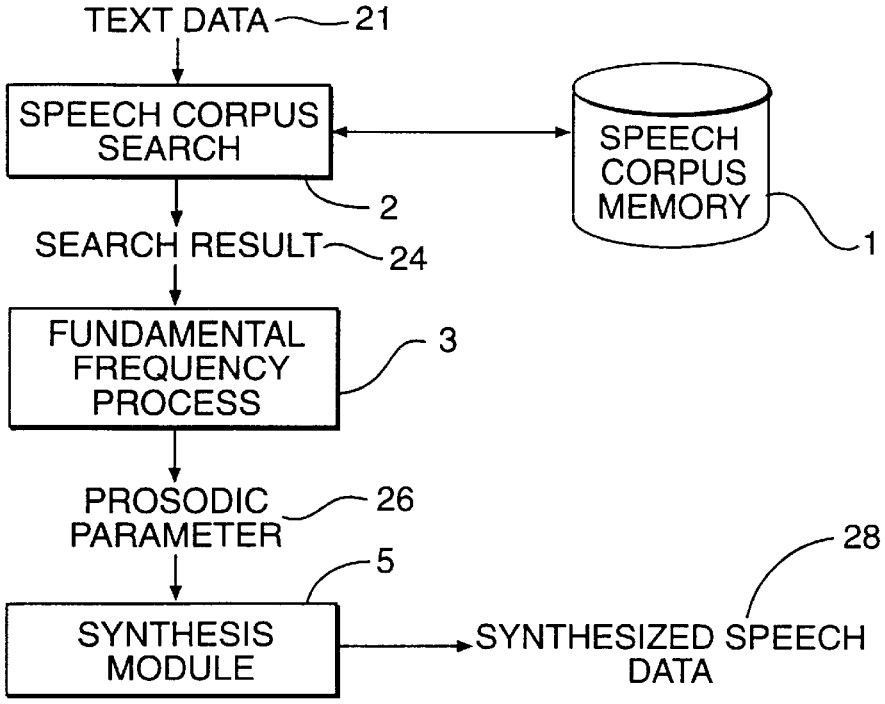
FIG. 3 shows a flow chart in the speech synthesis system based on the present invention.

FIG. 3 shows a flow chart of a speech synthesis process of the present invention. The speech corpus search portion 2 performs an analysis of an input text data 21 to determine the prosody data of the input text data, and then performs a search of the speech corpus memory 1 to find prosody data which is the most similarity to the determined prosody data. A search result 24 is temporarily stored as search data 13 and is input to the fundamental frequency processing module 3. When stored prosody data with a threshold similarity to the input text data 21 does not exist in the speech corpus memory 1, a negative result that stored prosody data that has a threshold similarity does not exist is output as the search result 24. In the fundamental frequency processing module 3, a prosodic parameter 26 is computed based on the search result 24 and the input text data 21. In the synthesis module 5, a synthesized speech data 28 is produced by using the computed prosodic parameter 26.

By using a text data 31, for example, a method for converting from a text data to a synthesized speech based on the present invention is described by reference to the following figures. The text data 31 is offered by Japanese in this embodiment. Japanese sound of the text data 31 is "SHIBUYA MADE JUTAI SHITE IMASU" and its meaning is "There is a traffic jam to Shibuya". Though the explanation of this invention is shown by using Japanese example text, English text is synthesized to English speech by the same way. This invention is applied to not only Japanese but also other languages.

Figure 4:
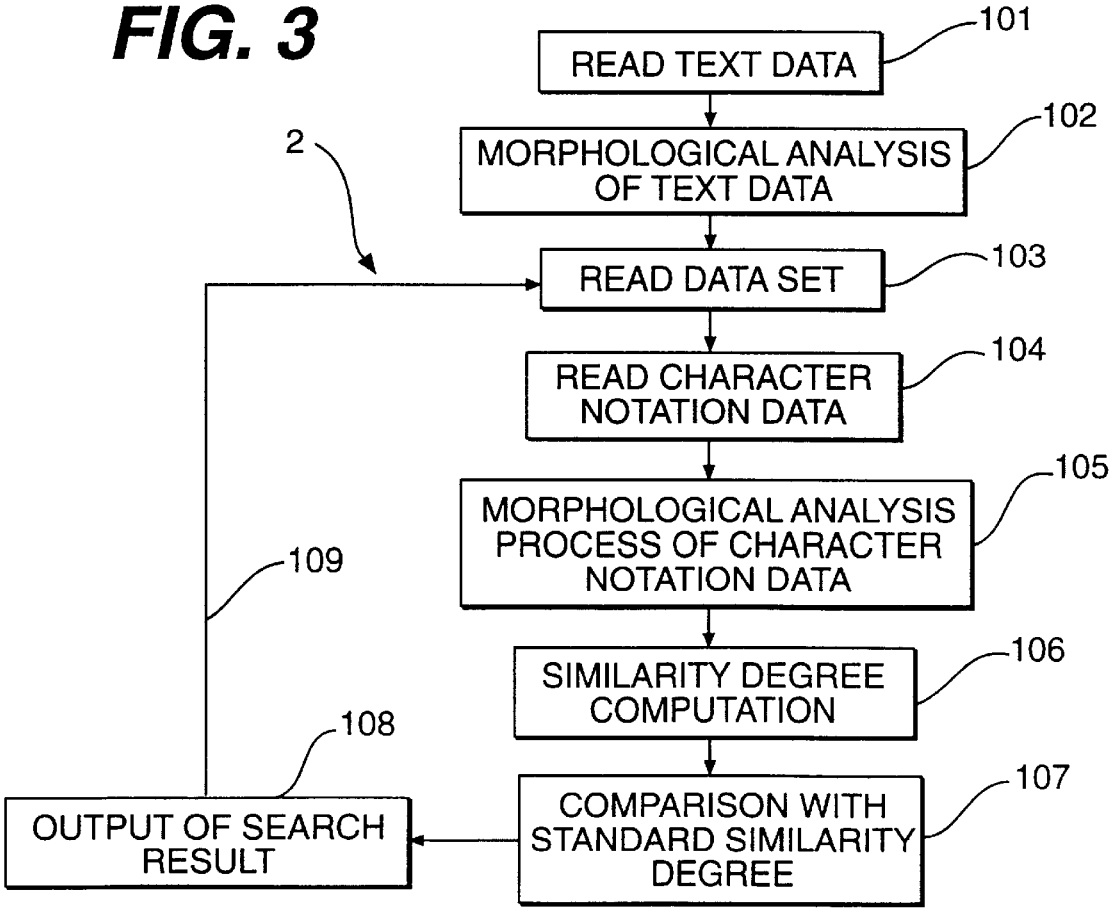
FIG. 4 shows an example flow chart in a speech corpus search portion.
Figure 5:
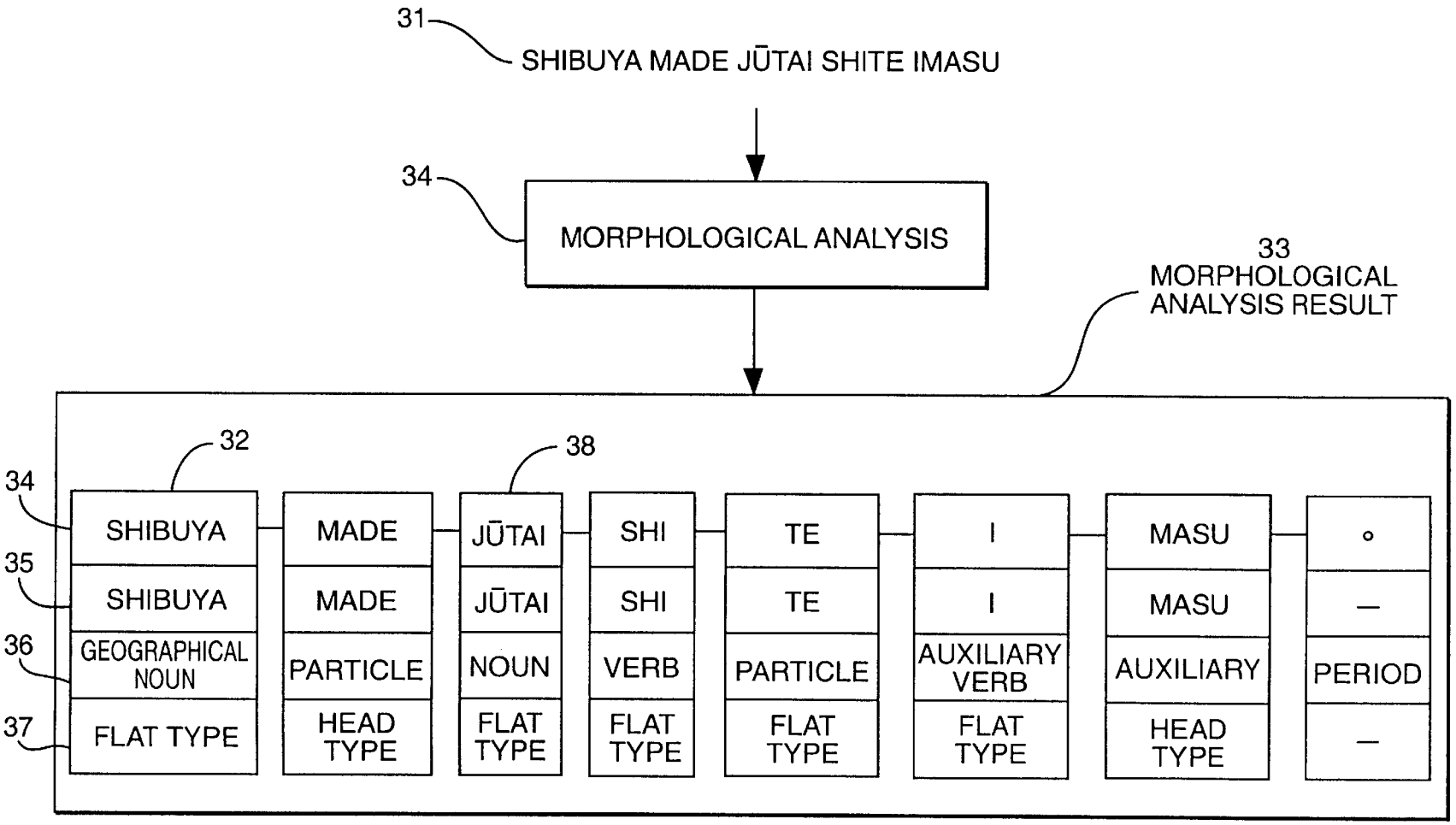
FIG. 5 shows an example conversion from a text data to a morphological analysis result.

FIG. 4 shows a flow chart of the speech corpus search conducted in the speech corpus search portion 2, of FIG. 3. A specific text data 31 "SHIBUYA MADE JUTAI SHITE IMASU" of FIG. 5, as an example of input text data 21, is read from the text data 10 of the memory 6 in FIG. 2, in the step 101. The readout text data 31 of FIG. 5 is divided into words and converted into a structured parameter sequence 33 as in FIG. 5, including a notation 34 (here a romanized translation of the Japanese text that is in the Japanese language is not the same as the text 35), a phonetic read 35 (here romanized as a translation of the Japanese phonetic text), a part of speech 36 and accent information 37 for each word in a morphological analysis process 102 of FIG. 4. The structured parameter sequence is the morphological analysis result 33 as in FIG. 5, and it is stored as the data during computing processing 14 in the memory 6, as in FIG. 2. A process described in Shimizu et al, "A Morphological Analyzer for a Japanese Text-to-Speech System Based on the Strength of Connection Between Words", Journal of the Japan Acoustical Society, Vol. 51, No. 1, pages 3–13, 1995, can be used herein as a method for dividing text data into words and punctuation. The phonetic read 35 and the accent information 37 for a word set or notation 34 is obtained from data registered in a dictionary by means of a look-up function.

Figure 6:
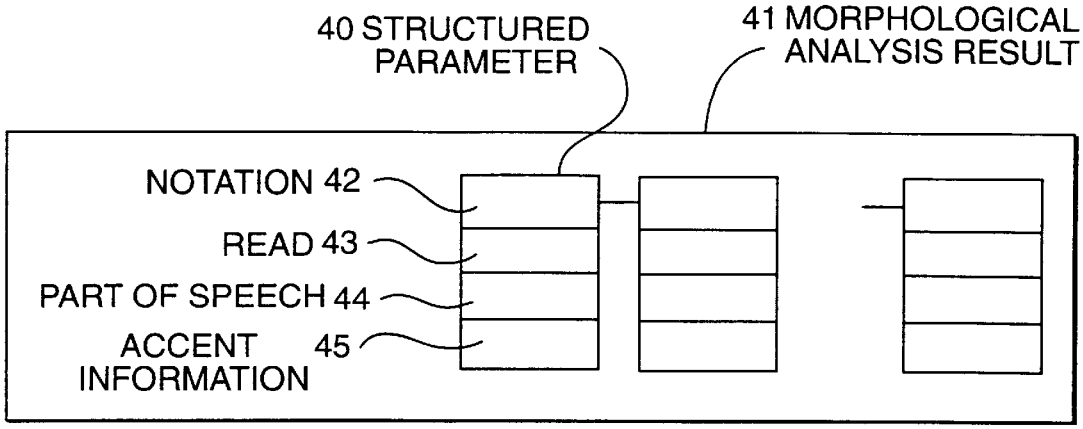
FIG. 6 shows a structured parameter sequence for the morphological analysis result.

FIG. 6 shows the morphological analysis result as a structured parameter sequence. A word structured parameter 40 includes a notation or orthography 42, a phonetic read 43, a part of speech 44 and an accent information 45 for a word. Because a text data 31 as in FIG. 5 is for instance, divided into "shibuya/made/jutai/shi/te/i/masu/." in the Japanese language, a result of morphological analysis is a structured parameter sequence 33 for each word, for example the two words 32 and 38.

Figure 7:
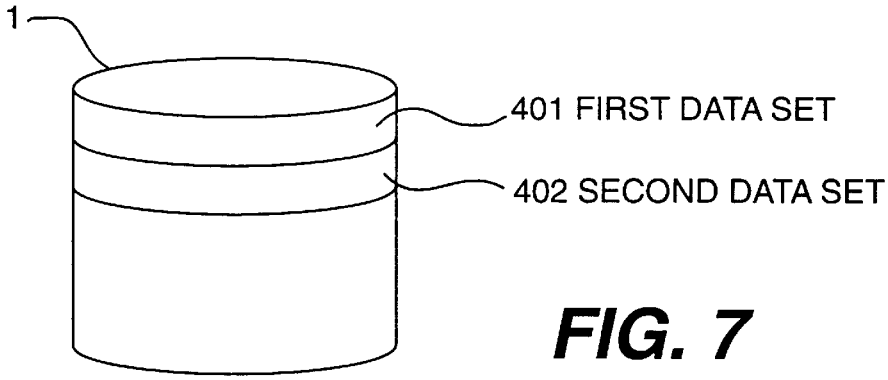
FIG. 7 shows an example data structure of a speech corpus.
Figure 8:
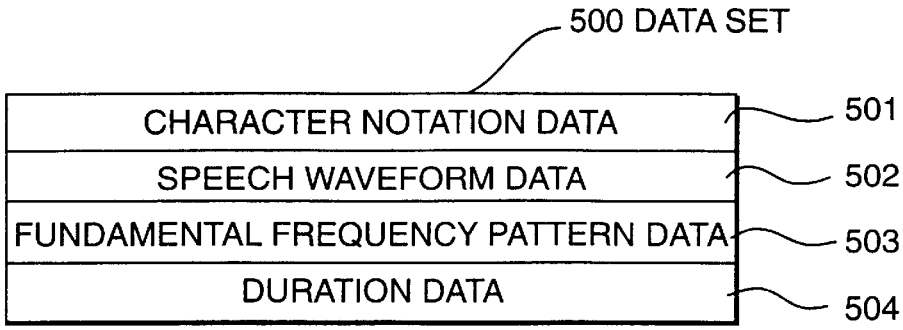
FIG. 8 shows an example data structure for a data set of a speech corpus.

In step 103 of FIG. 4, one data set is read from the speech corpus memory 1, in FIG. 1. FIG. 7 shows a data structure of the speech corpus memory 1. The speech corpus memory 1 includes a plurality of data sets 401, 402, etc. Each data set of FIG. 7 includes, as shown in FIG. 8 for a specific data set 500, character notation or orthography data 501, speech waveform data 502 for vocalizing the character notation data 501, fundamental frequency pattern data 503 of the speech waveform data 502, and duration data 504 of the speech waveform data 502. The data set 500 may include other prosodic parameters (such as a power), an acoustic parameter (such as sepstrum) and a morphological analysis result of the character notation or orthography data 501.

Figure 9:
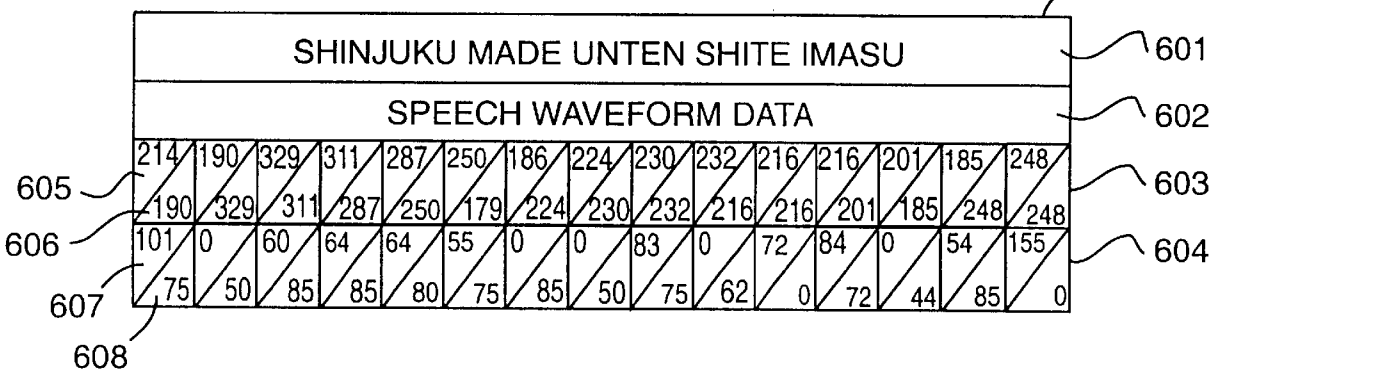
FIG. 9 shows an example data set.

The data set 500 of the speech corpus memory 1 is further described by using an example data set 600, wherein the character notation data 601 is a sentence "SHINJUKU MADE UNTEN SHITE IMASU" which means "I will drive to Shinjuku" having speech waveform data 602 as shown in FIG. 9. A fundamental frequency pattern data 603 is stored as a fundamental frequency sequence of the start point frequency and end point frequency of each syllable. For instance, a fundamental frequency at the start point 605 for the first syllable "shi" of the character notation data 601 is "214" and the fundamental frequency at its end point 606 for that syllable is "190". Duration data 604 of the first syllable "shi" is stored in milliseconds, with a duration 607 of a consonant being "101" and a duration 608 of a vowel being "75".

Figure 10:
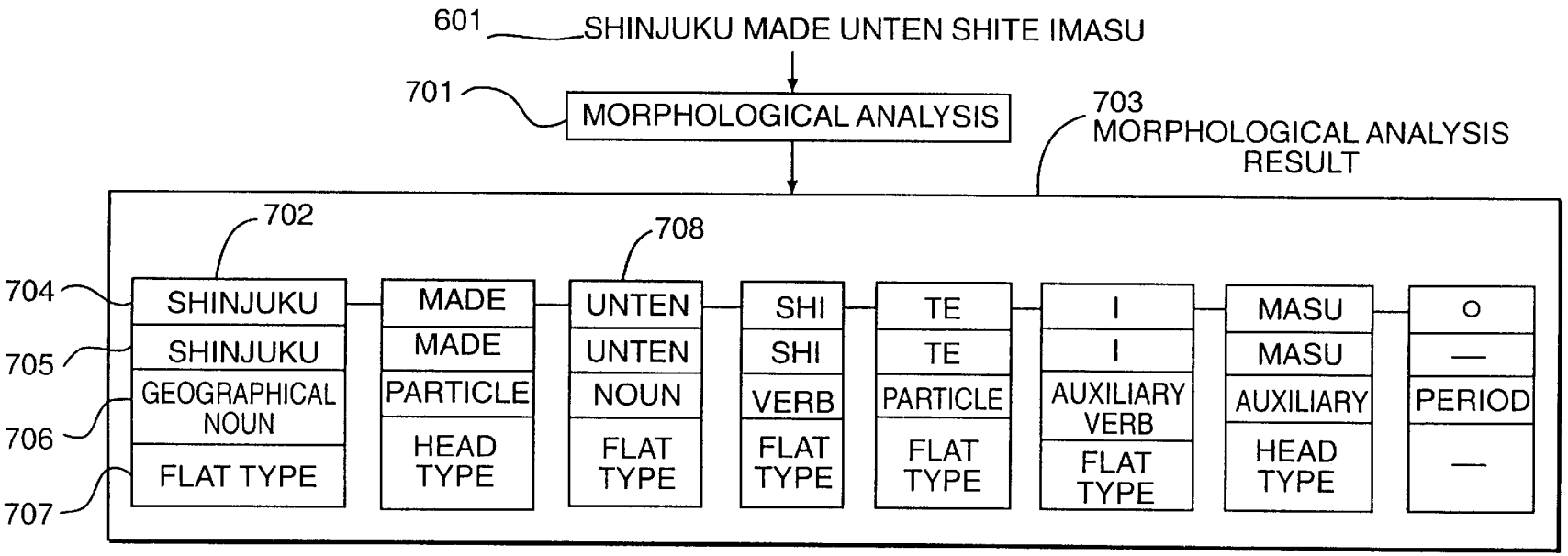
FIG. 10 shows an example conversion from a character notation data of the data set to a morphological analysis result.

In the speech corpus search portion 2 in FIG. 1, the character notation data 601 of the data set 600 is read in the step 104 of FIG. 4 and a morphological analysis process 105 is performed on the character notation data (step 701 in the specific example of FIG. 10) to yield a morphological analysis result 703 that is stored as data during computer processing 14 in the memory 6; the specific example of performing morphological analysis is shown in FIG. 10 for the step 105 of FIG. 4. The result of morphological analysis 703 has morpheme 702 comprising Kanji character, reading, grammatical function of the word and accent type information. When the data set 600 includes a morphological analysis result, the process in the step 105 is not necessary.

Computation of similarity degree is performed in the step 106 of FIG. 4, by reading from the memory 6 in FIG. 1 a morphological analysis result 33 obtained from the input text data 31 in FIG. 5 and a morphological analysis result 703 of the speech corpus character notation data 601 in the data set 600 in FIGS. 9 and 10.

Figure 11:
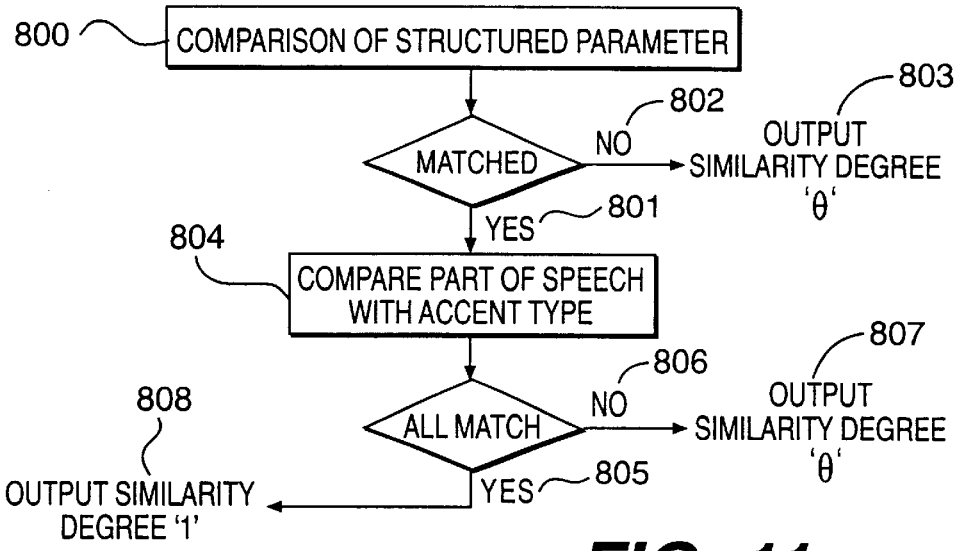
FIG. 11 shows an example flow chart for computing a similarity degree.

An example computation of similarity degree is described by using FIG. 11. Structured parameter values between a morphological analysis result 33 of input text as in FIG. 5 and a morphological analysis result 703 of speech corpus data as in FIG. 10 are compared in the step 800. Structured parameter values for the morphological analysis results 33 and 703 are both "8" as a degree of similarity, thereby both results are matched. When structured parameter values are matched as indicated by a YES result 801, the step 804 is processed. When not matched as indicated by a NO result 802, a similarity degree "0" is determined and output at stage 803; the process of similarity degree computation 106 as in FIG. 4 is ended in the steps 802 and 803.

When structured parameter values from the input text and the speech corpus are matched, comparison of a part of speech with an accent type is then performed for the structured parameters in the step 804 of FIG. 11. Each structured parameter Di (i=1 to n) from the morphological analysis result 33 and each structured parameter D' i (i=1 to n) from the morphological analysis result 703 are compared, respectively. For instance, as for D1 "shibuya" and D'1 "shinjuku", because a part of speech of both structured parameters D1 and D'1 is a "geographical noun" and an accent type of both is a "flat type", both structured parameters D1 and D'1 are matched. In the same manner, comparison of a part of speech with an accent type is performed for all of the structured parameters Di and D'i, and when all of the structured parameters are matched as indicated by a YES output 85, a similarity degree "1" is determined by output step 808 and computation of similarity degree is ended in the step 808. When there is any one of the structured parameters that are not matched as determined by a NO 806, a similarity degree "0" is output in the step 807. The output similarity degree is stored as data during computer processing 14 in the memory 6, in FIG. 2.

The similarity degree is read from the data during computer processing 14 in the memory 6, the read similarity degree is compared with a threshold value that is a predetermined standard similarity degree in the step 107 of FIG. 4 and a search result is output in the step 108, of FIG. 4. When computation of similarity degree is performed as indicated in FIG. 11, a predetermined standard similarity degree is set to "1" . When a computed similarity degree by the similarity degree computation 106 in FIG. 4 is "1" , "matched"is output as a comparison result. When a similarity degree is "0", "non-matched" is the output of search result 108 in FIG. 4. When a result of similarity degree comparison is "non-matched" then processing returns to step 103 by line 109, so that data sets stored in the speech corpus memory 1 in FIG. 1 are sequentially read in the step 103 of FIG. 4 and computation of similarity degree is performed by looping through steps 103, 104, 105, 106, 107, 108 until there is a match "1" of input and corpus data sets or the data sets are exhausted in the speech corpus. When a result of similarity degree comparison is "matched" as determined by one loop of steps 103, 104, 105, 106, 107, a matched data set 600 in FIG. 9 is output and stored as a result of speech corpus search 13 in the memory 6 of FIG. 2 by steps 108; later this search result is read from memory 6 and input as search result 24 of FIG. 3.

When there is no data set for satisfying a standard similarity degree as a result of performing the above similarity degree computer processing (steps 103, 104, 105, 106, 107, 108 in a loop) for all data sets of the speech corpus memory 1, a data flag (called a non-similar data flag) indicating the status is output by step 108 as the result of speech corpus search 13 and stored in the memory 6 of FIG. 2. Through the above similarity degree computer processing, more than one data set having a similarity or the non-similar data flag are output as a result of speech corpus search 13 and stored in the memory 6 of FIG. 2.

Figure 12:
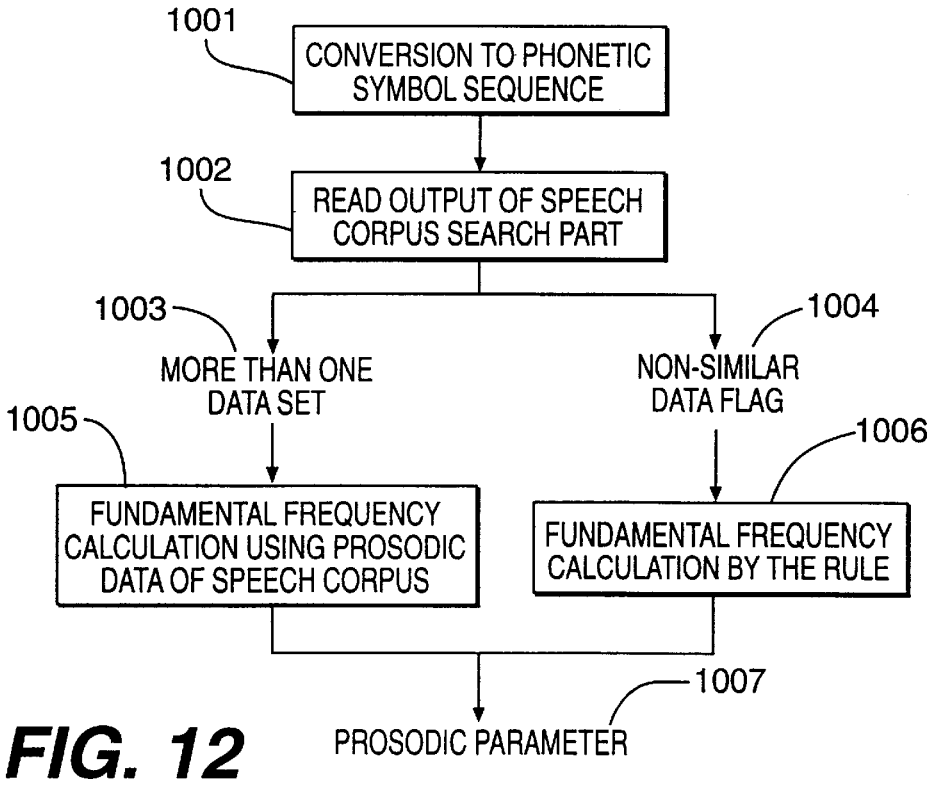
FIG. 12 shows an example flow chart in a fundamental frequency calculating module.
Figure 13:
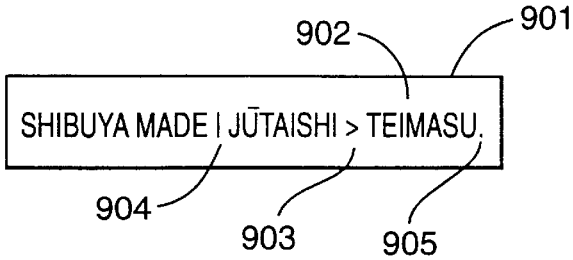
FIG. 13 shows an example phonetic symbol sequence.

FIG. 12 shows a flow chart of processing in the fundamental frequency process module 3 of FIG. 3. The input text data 31, as in FIG. 5 is read and a phonetic symbol sequence 35 is produced in the step 1001. A method for converting a text data to the phonetic symbol sequence is described in Sagisaka et al, "Accent Rule for Japanese Word Concatenation", Proceedings of the Electronic Information Communications Conference, J66-D, No. 7, pages 849–856, 1983. FIG. 13 shows an example 901 of the phonetic symbol sequence 35. The phonetic symbol sequence 901 includes a punctuation of a phrase or syllable break 904, a period 905, a symbol of unvoiced vowel 903 and an accent symbol 902 in addition to a read of the input text information. For generating the phonetic symbol sequence 901, the morphological analysis result 33 for the text data 31 in FIG. 5 is stored in the memory 6 of FIG. 1.

The result of similarity degree computer processing is read from the result of speech corpus search 13 stored in the memory 6, as in FIG. 2, in the step 1002 of FIG. 12. The result of similarity degree computer processing is either of (1) one or more than one data set 1003 using, e.g., fuzzy logic, or (2) a non-similar data flag 1004.

When there exits more than one similar data set, one data set is selected. This data set is called the "selected data set". For the input text data 31 "There is a traffic jam to Shibuya." as in FIG. 5, the speech corpus data set 600 "I will drive to Shinjuku.", as in FIG. 9, becomes an example of the selected data set. The selected data set 600 is data having a similar prosody with the input text data 31, in FIG. 5. This is because, as in FIGS. 5 and 10, morphological analysis results of both data sets have identical structured parameters other than structured parameters corresponding to the word "shibuya" 32 in FIG. 5 and the word "shinjuku" 702 in FIG. 10, and structured parameters corresponding to the word "jutai" 38 in FIG. 5 and the word "unten" 708 in FIG. 10, and a part of speech and an accent type are identical for different structured parameters as well.

When the fundamental frequency pattern data 603 and the duration data 604, being the prosodic parameters of the selected data set 600 in FIG. 9, are utilized in step 1005 to compute corresponding prosodic parameters for the input text data 31 in FIG. 5, prosodic parameters 1007 similar to prosodic parameters of natural speech are obtained and provided as the output 26 in FIG. 3, and natural characteristics are much improved over the prior art. A method for computing a prosodic parameter is described by using FIG. 14.

Figure 14:
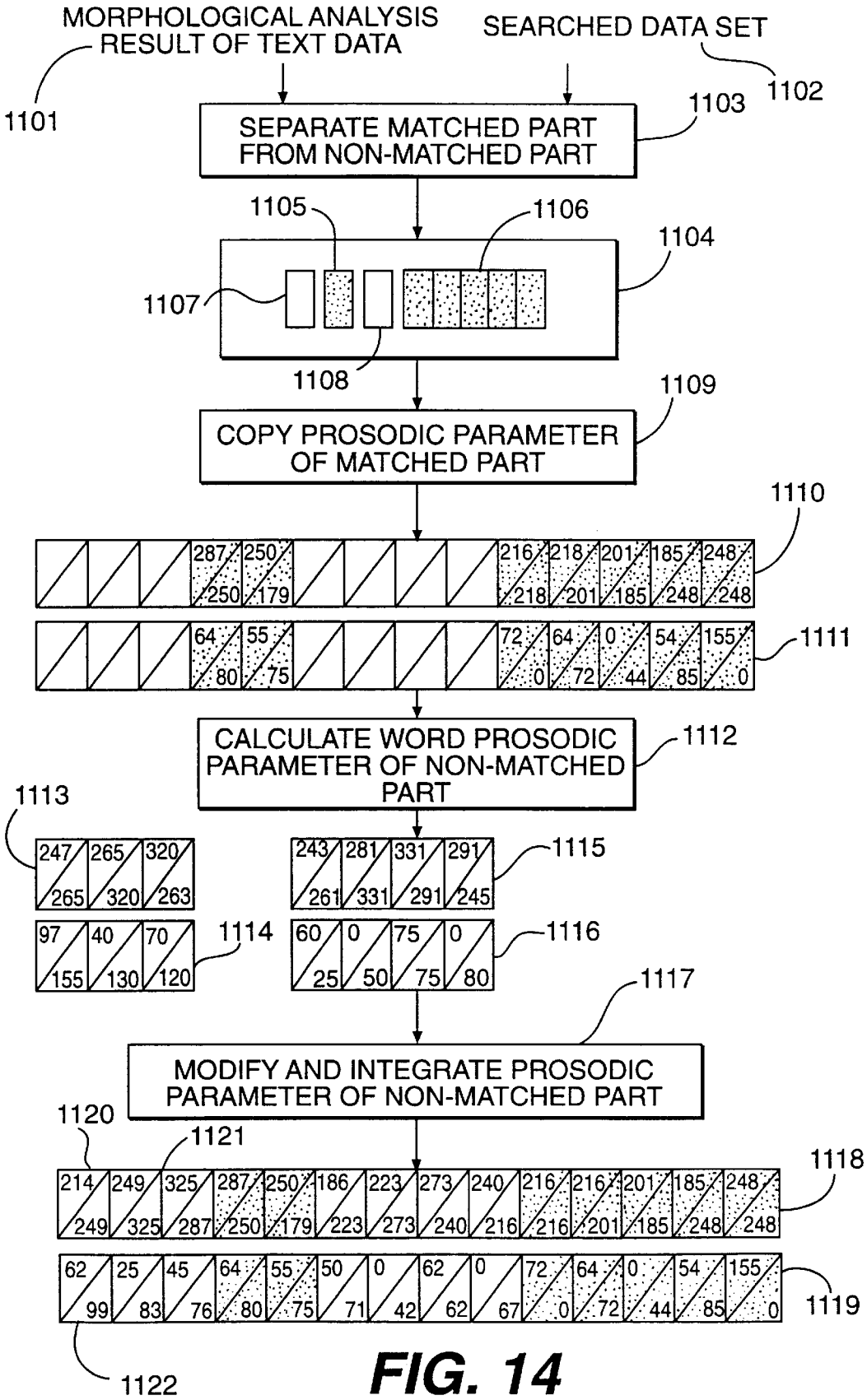
FIG. 14 shows an example prosodic parameter computation by using a speech corpus data.

In step 5 of FIG. 3, for a morphological analysis result 1101 of input text data (the morphological analysis result 33 in FIG. 5) and a selected data set 1102 (the morphological analysis result 703 in FIG. 10 of data set 600), separation between matched and non-matched portions is performed in the step 1103 in FIG. 14. A separated result is represented in the step 1104, structured parameters 1105 and 1106 indicate matched structured parameters and structured parameters 1107 and 1108 indicate non-matched structured parameters (in the aforementioned example, these are structured parameters 32 and 702, and structured parameters 38 and 708).

In step 1109, a data sequence including the number of syllable of the input text data 31 "SHIBUYA MADE JUTAI SHITE IMASU", in FIG. 5, is produced and the prosodic parameters of the matched portion are copied for the input text data based on the separated result 1104. For a prosodic parameter of a matched portion, a prosodic parameter of the selected data set 1102 (the data set 600 in FIG. 9) is used. The matched data portions of the fundamental frequency pattern data 603 are copied as data 1110 and the duration data 604 are copied as data 1111 as the corresponding prosodic parameters of the input text data 31 in FIG. 5. Each matched portion of the data 1110 and 1111 stores a prosodic parameter of a syllable corresponding to a matched structured parameter and each blank or non-matched portion of the data 1110 and 1111 stores a null prosodic parameter of syllable corresponding to a non-matched structured parameter.

A prosodic parameter is computed for each syllable of a non-matched portion in the step 1112, in FIG. 14. For a fundamental frequency pattern, a word fundamental frequency pattern is obtained by preparing a word fundamental frequency pattern table for storing one fundamental frequency pattern data with the number of morae for a word and an accent type, and by searching the word fundamental frequency pattern table. A word duration is obtained according to the teachings of Sagisaka et al, "Phoneme Duration Control for Speech Synthesis by Rule", Shingaku-ron, Vol. J67-A, No. 7, pages 629–636, 1984.

Based upon this published method, word fundamental frequency pattern data 1113 and 1115 of non-matched portions and duration data 1114 and 1116 of non-matched portions are obtained.

The prosodic parameters of non-matched portions of data 1110 and 1111 are thereby modified to data 1113, 1114, 1115, 1116 and integrated with the matched portions of data 1110 and 1111 so as to combine the calculated prosodic parameters of non-matched portions with the speech corpus prosodic parameters of matched portions smoothly in the step 1117, in FIG. 14. For a fundamental frequency pattern data, the word fundamental frequency pattern data is modified linearly so that a fundamental frequency value at the start point of syllable 1120 and a fundamental frequency value at the end point of syllable 1121 matches with a fundamental frequency value of to the selected data set 1102 (the data set 600 in FIG. 9). For the duration of a word 1122, by employing a value (a duration L for morae) obtained through division of a word duration by a morae value in the selected data set 1102, the duration data 1114 and 1116 are expanded and contracted so that a duration for morae in the duration data 1114 and 1116 is equal to L. Accordingly, a word fundamental frequency pattern data 1118 and a corresponding duration data 1119 are computed as the prosodic parameters of the input text data 31 in FIG. 5 and output as the synthesized speech data 28 of FIG. 3.

When the non-similar data flag 1004 is output from the speech corpus search portion 2, a prosodic parameter can not be computed by using a prosodic parameter of the speech corpus. Therefore, a prosodic parameter is computed by using the phonetic symbol sequence 901 in FIG. 13 with the above-mentioned published method, in the step 1006 of FIG. 12. In this case, because natural characteristics are less than a speech synthesized from a speech corpus, it is desirable to store a speech corpus in a huge capacity of memory media for synthesizing an arbitrary sentence and the speech corpus can be stored in a magnetic memory media, an optical memory media, a magneto-optical memory media or flash memory. The speech corpus can also be stored commonly for a plurality of speech synthesis systems and accessed via a transmission line.

The prosodic parameters 1007 obtained in FIG. 12 are stored as the prosodic parameter 11 in the memory 6 of FIG. 2.

The fundamental frequency pattern and the duration computed by the fundamental frequency calculating module 4 are read from the prosodic parameters 11 of the memory 6 in FIG. 2 and an output speech waveform is synthesized in the synthesis module 5. A synthesized waveform data is stored as the synthesized speech data 12 in the memory 6 of FIG. 2.

Based on the present invention, a synthesized sound similar to natural speech having natural intonation and prosody is produced.

While preferred embodiments have been set forth with specific details, further embodiments, modifications and variations are contemplated according to the broader aspects of the present invention, all as determined by the spirit and scope of the following claims.

What is claimed is:

1. A prosodic control method, used in speech synthesis for computing prosodic parameters for input text data and producing synthesized speech by using the computed prosodic parameter, the method comprising the steps of:

providing a speech corpus storing a plurality of sets of prosodic parameters, each set based on human vocalization of plural word text data, and a plurality of sample text data sets respectively associated with the sets of prosodic parameters;

comparing the input text data as a set of words with the plurality of sample text data sets stored in the speech corpus sequentially;

selecting a similar prosody sample text data set from the speech corpus based upon the results of the step of comparing;

acquiring prosodic parameters for any non-matched portions between the selected text data set and the input text data set; and computing each prosodic parameter for a matched portion between the selected text data set and the input text data set, and computing each prosodic parameter for any non-matched portion.

2. The prosodic control method of claim 1, including storing fundamental frequency pattern and duration as at least some of the prosodic parameters stored in the speech corpus.

3. The prosodic control method of claim 1, including performing morphological analysis of the input text data set, and thereby obtaining a part of speech and an accent type for each morphological element that is a result of the analysis, i.e. morpheme, Di (i=1 to n); and said selecting performing comparison between each morphological element Di, the part of speech and the accent type for each morphological element D'j (j=1 to n) of text data sets in the speech corpus to obtain a degree of similarity that is the number of morphological elements matched with each text data set stored in the speech corpus.

4. The prosodic control method of claim 3, said acquiring including providing a word fundamental frequency pattern table for storing more than one fundamental frequency pattern for a combination of the number of morae for a word and an accent type for each word, for non-matched portions between the selected text data set and the input text data set; and said computing including computing a fundamental frequency pattern of the non-matched portions by tabulating the word fundamental frequency pattern table.

5. The prosodic control method of claim 2, including performing morphological analysis of the input text data set, and thereby obtaining a part of speech and an accent type for each morphological element that is a result of the analysis, i.e. morpheme, Di (i=1 to n); and said selecting performing comparison between each morphological element Di, the part of speech and the accent type for each morphological element D'j (j=1 to n) of text data sets in the speech corpus to obtain a degree of similarity that is the number of morphological elements matched with each text data set stored in the speech corpus.

6. The prosodic control method of claim 5, said acquiring including providing a word fundamental frequency pattern table for storing more than one fundamental frequency pattern for a combination of the number of morae for a word and an accent type for each word, for non-matched portions between the selected text data set and the input text data set; and said computing including computing a fundamental frequency pattern of the non-matched portions by tabulating the word fundamental frequency pattern table.

7. The prosodic control method of claim 3, said acquiring including providing a word fundamental frequency pattern table for storing more than one fundamental frequency pattern for a combination of the number of morae for a word and an accent type for each word, for non-matched portions between the selected text data set and the input text data set; and said computing including computing a fundamental frequency pattern of the non-matched portions by tabulating the word fundamental frequency pattern table.

8. The prosodic control method of claim 2, said acquiring including providing a word fundamental frequency pattern table for storing more than one fundamental frequency pattern for a combination of the number of morae for a word and an accent type for each word, for non-matched portions between the selected text data set and the input text data set; and said computing including computing a fundamental frequency pattern of the non-matched portions by tabulating the word fundamental frequency pattern table.

9. A speech synthesis system, comprising:

a speech corpus memory;

a speech corpus search portion for searching for a matched text data set of words having a similar prosody to an input text data set of words from the speech corpus memory by analyzing the input text data set of words;

a fundamental frequency processing module for setting a search result in said speech corpus search portion as an input and computing a prosodic parameter of non-matched portions of the set of the search result; and a synthesis module for producing synthesized speech data by using said prosodic parameter.

10. The speech synthesis system of claim 9, wherein in said speech corpus search portion, each text data set is divided into words and a morphological analysis result of a structured parameter sequence including a notation, a read, a part of speech and an accent information for each word.

11. The speech synthesis system of claim 9, wherein said speech corpus search portion performs a similarity degree computation by comparing morphological analysis results of the input text data set and the stored text data set as the number of matched structured parameters, parts of speech and accent types.

12. The speech synthesis system of claim 9, wherein said fundamental frequency processing module processes a prosodic parameter which the search result indicates by using a phonetic symbol sequence produced from the input text data set.

13. The speech synthesis system of claim 10, wherein said speech corpus search portion performs a similarity degree computation by comparing morphological analysis results of the input text data set and the stored text data set as the number of matched structured parameters, parts of speech and accent types.

14. The speech synthesis system of claim 13, wherein said fundamental frequency processing module processes a prosodic parameter which the search result indicates by using a phonetic symbol sequence produced from the input text data set.

15. The speech synthesis system of claim 10, wherein said fundamental frequency processing module processes a prosodic parameter which the search result indicates by using a phonetic symbol sequence produced from the input text data set.

16. A speech synthesis system, comprising:

means for providing a speech corpus storing a plurality of sets of prosodic parameters, each set based on human vocalization of plural word text data, and a plurality of sample text data sets respectively associated with the sets of prosodic parameters;

means for comparing the input text data as a set of words with the plurality of sample text data sets stored in the speech corpus;

means for selecting a best matched sample text data set from the speech corpus;

means for acquiring prosodic parameters for any non-matched portions between the selected text data set and the input text data set;

means for computing each prosodic parameter for a matched portion between the selected text data set and the input text data set, and computing each prosodic parameter for any non-matched portion; and wherein in said speech corpus search portion, each text data set is divided into words and a morphological analysis result of a structured parameter sequence including a notation, a read, a part of speech and an accent information for each word.

17. A speech synthesis system according to claim 16, wherein in said speech corpus, each text data set is divided into words and a morphological analysis result of a structured parameter sequence including a notation, a read, a part of speech and an accent information for each word.

18. A speech synthesis system according to claim 17, wherein said means for selecting performs a similarity degree computation by comparing morphological results of the input text data set and the stored text data set as the number of matched structured parameters, parts of speech and an accent types.

19. A speech synthesis system according to claim 17, including means for storing fundamental frequency pattern and duration as at least some of the prosodic parameters stored in the speech corpus;

means for performing morphological analysis of the input text data set, and thereby obtaining a part of speech and an accent type for each morphological element that is a result of the analysis, i.e. morpheme, Di (i=1 to n); and said means for selecting performing comparison between each morphological element Di, the part of speech and the accent type for each morphological element D'j (j=1 to n) of text data sets in the speech corpus to obtain a degree of similarity that is the number of morphological elements matched with each text data set stored in the speech corpus.

20. A speech synthesis system according to claim 19, wherein said means for acquiring provides a word fundamental frequency pattern table for storing more than one fundamental frequency pattern for a combination of the number of morae for a word and an accent type for each word, for non-matched portions between the selected text data set and the input text data set; and said means for computing including computing a fundamental frequency pattern of the non-matched portions by tabulating the word fundamental frequency pattern table.

* * * * *